US009931870B2

(12) United States Patent
Kurotobi et al.

(10) Patent No.: US 9,931,870 B2
(45) Date of Patent: Apr. 3, 2018

(54) PRINTER

(71) Applicant: SEIKO EPSON CORPORATION, Tokyo (JP)

(72) Inventors: Shuhei Kurotobi, Matsumoto (JP); Nobuhiro Inoue, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/487,073

(22) Filed: Apr. 13, 2017

(65) Prior Publication Data

US 2017/0297350 A1 Oct. 19, 2017

(30) Foreign Application Priority Data

Apr. 15, 2016 (JP) ..... 2016-081601

(51) Int. Cl.

| | |
|---|---|
| ***B41J 11/04*** | (2006.01) |
| ***B41J 11/057*** | (2006.01) |
| ***B41J 11/42*** | (2006.01) |
| ***B41J 13/03*** | (2006.01) |
| ***B41J 13/036*** | (2006.01) |
| ***B41J 15/04*** | (2006.01) |

(Continued)

(52) U.S. Cl.

CPC ..... *B41J 11/04* (2013.01); *B41J 2/01* (2013.01); *B41J 11/006* (2013.01); *B41J 11/057* (2013.01); *B41J 11/06* (2013.01); *B41J 11/42* (2013.01); *B41J 13/03* (2013.01); *B41J 13/036* (2013.01); *B41J 13/042* (2013.01); *B41J 15/042* (2013.01); *B41J 15/046* (2013.01)

(58) Field of Classification Search

CPC ... B41J 2/01; B41J 11/006; B41J 11/04; B41J 11/057; B41J 11/06; B41J 11/42; B41J 13/03; B41J 11/036; B41J 11/042; B41J 15/042; B41J 15/046

See application file for complete search history.

(56) References Cited

U.S. PATENT DOCUMENTS 5,316,395 A * 5/1994 Imai ..... B41J 3/283 400/56
5,344,246 A * 9/1994 Imoto ..... B41J 11/02 400/552

(Continued)

FOREIGN PATENT DOCUMENTS

JP 2011-201224 A 10/2011

*Primary Examiner* — Anh T. N. Vo
(74) *Attorney, Agent, or Firm* — Foley & Lardner LLP

(57) ABSTRACT

A printer can suppress paper lifting away from the platen surface even when conveying strong paper (regardless of paper strength) (a printer that can suppress paper uplift from the platen and is not easily affected by the type of paper). A printer 40 in which the platen surface 42*a* is on the inkjet head 21 side of a plane C through position A where paper 11 is held by a conveyance roller 36, and position B where the paper is held by a discharge roller, has: on the printhead 21 side of the plane C between the platen 42 and conveyance roller 36, at least one entry angle control unit 44 that contacts the paper 11 conveyed toward the platen surface 42*a*, and controls the entry angle of the paper 11 to the platen surface 42*a*; and on the printhead 21 side of the plane C between the platen 42 and the discharge roller 37, at least one exit angle control unit 46 that contacts the paper 11 conveyed in the direction away from the platen surface 42*a*, and controls the exit angle of the paper 11 from the platen surface 42*a*.

7 Claims, 10 Drawing Sheets

(51) Int. Cl.

| | |
|---|---|
| ***B41J 2/01*** | (2006.01) |
| ***B41J 11/00*** | (2006.01) |
| ***B41J 11/06*** | (2006.01) |
| ***B41J 13/042*** | (2006.01) |

(56) References Cited

U.S. PATENT DOCUMENTS 5,742,318 A * 4/1998 Miyauchi ..... B41J 13/03
271/251
6,293,670 B1 * 9/2001 Taniguro ..... B41J 11/005
347/104
6,616,361 B2 * 9/2003 Sugiyama ..... B41J 11/06
347/104
8,833,919 B2 * 9/2014 Love ..... B41J 2/16585
347/101

* cited by examiner

PRINTER

BACKGROUND

1. Technical Field

The invention relates to a printer, and relates more particularly to a printer capable of suppressing paper from lifting away from the platen even when conveying stiff paper (more specifically, regardless of the stiffness of the paper), that is, a printer that can suppress media uplift from the platen without being easily affected by the type of paper.

2. Related Art

A printer having a printhead; a platen with a platen surface opposite the printhead; a conveyance roller disposed on the upstream side of the platen in the conveyance direction to convey paper (roll paper) to the platen surface; and a discharge roller disposed on the downstream side of the platen in the conveyance direction to convey the paper in the direction away from the platen surface; and preventing paper from lifting away from the platen surface by disposing the platen surface on the printhead side of a plane through the position where the paper is held by the conveyance roller and the position where the paper is held by the discharge roller, is known from the literature. See, for example, JP-A-2011-201224.

The printer described in JP-A-2011-201224 can prevent paper from lifting away from the platen surface when conveying weak paper (paper with a relatively low basis weight; relatively thin paper), but when conveying strong paper (paper with a relatively high basis weight; relatively thick paper), the paper may lift up from the platen surface (such as in the middle of the platen).

SUMMARY

The present invention is directed to solving the foregoing problem, and an objective of the invention is to provide a printer that can suppress separation of paper from the platen surface even when conveying relatively strong paper (regardless of paper strength), that is, a printer that suppresses paper uplift regardless of the type of paper.

To achieve the above objective, one aspect of the invention is a printer including a printhead; a platen with a platen surface opposite the printhead; a conveyance roller disposed upstream in the media conveyance direction from the platen to convey paper to the platen surface; and a discharge roller disposed downstream in the media conveyance direction from the platen to convey paper away from the platen surface, the platen surface being disposed on the printhead side of a plane tangent to the conveyance roller and discharge roller; at least one entry angle control unit disposed on the printhead side of the plane between the platen and the conveyance roller, contacting the paper conveyed toward the platen surface, and controlling the entry angle of the paper to the platen surface; and at least one exit angle control unit disposed on the printhead side of the plane between the platen and the discharge roller, contacting the paper conveyed away from the platen surface, and controlling the exit angle of the paper to the platen surface.

This aspect of the invention provides a printer that can suppress uplift of paper from the platen surface even when conveying relatively strong paper (regardless of paper strength), that is, a printer that suppresses paper uplift regardless of the type of paper.

This is possible because the entry angle of paper (strong paper, paper with a high basis weight) to the platen surface is controlled to a shallow angle by the action of the entry angle control unit, and the exit angle of paper (strong paper, paper with a high basis weight) from the platen surface is controlled to a shallow angle by the action of the exit angle control unit.

Preferably, in a printer according to another aspect of the invention, the conveyance roller is a pair of rollers that hold and convey the paper toward the platen surface; the discharge roller is a pair of rollers that hold and convey the paper away from the platen surface; and the plane is a plane including the position where the paper is held by the conveyance roller, and the position where the paper is held by the discharge roller.

For the same reason described above, this aspect of the invention provides a printer capable of suppressing uplift of paper from the platen surface even when conveying stiff paper (that is, regardless of paper strength), that is, can provide a printer that can suppress paper uplift without being easily affected by the type of paper.

Preferably, in a printer according to another aspect of the invention, the entry angle control unit is disposed on the printhead side of the plane at a position between the platen and conveyance roller, where the paper substantially contacts the platen surface; and the exit angle control unit is disposed on the printhead side of the plane at a position between the platen and discharge roller, where the paper substantially contacts the platen surface.

For the same reason described above, this aspect of the invention provides a printer capable of suppressing uplift of paper from the platen surface even when conveying stiff paper (that is, regardless of paper strength), that is, can provide a printer that can suppress paper uplift without being easily affected by the type of paper.

Preferably, in a printer according to another aspect of the invention, the platen surface includes at least a first contact part that contacts the paper on the upstream side in the media conveyance direction, and a second contact part that contacts the paper on the downstream side in the media conveyance direction.

This aspect of the invention provides a printer having a platen surface including a first contact part and a second contact part.

Preferably, in a printer according to another aspect of the invention, there is a space between the first contact part and second contact part.

This aspect of the invention provides a printer having a platen surface that is the space between the first contact part and the second contact part.

Preferably, in a printer according to another aspect of the invention, the entry angle control unit, exit angle control unit, first contact part, and second contact part are line contact parts or rollers that line contact the paper.

This aspect of the invention provides a printer having contact parts or rollers that contact the conveyed paper in a line.

Preferably, a printer according to another aspect of the invention also has: at least one third contact part disposed upstream in the media conveyance direction from the first contact part on the opposite side of the platen surface as the printhead; and at least one fourth contact part disposed downstream in the media conveyance direction from the second contact part on the opposite side of the platen surface as the printhead. When the paper is paper of a first basis weight, the paper of the first basis weight contacts the platen surface by contacting the exit angle control unit, first contact part, and second contact part, and not contacting the third contact part and fourth contact part; and when the paper is paper of a second basis weight that is less than the first basis weight, the paper of the second basis weight contacts the platen surface by contacting the entry angle control unit, exit angle control unit, first contact part, second contact part, third contact part, and fourth contact part.

For the same reasons described above, this aspect of the invention provides a printer that can suppress uplift of paper from the platen surface even when conveying relatively strong paper (regardless of paper strength), that is, a printer that suppresses paper uplift regardless of the type of paper.

Other objects and attainments together with a fuller understanding of the invention will become apparent and appreciated by referring to the following description and claims taken in conjunction with the accompanying drawings.

DESCRIPTION OF EMBODIMENTS

Figure 1:
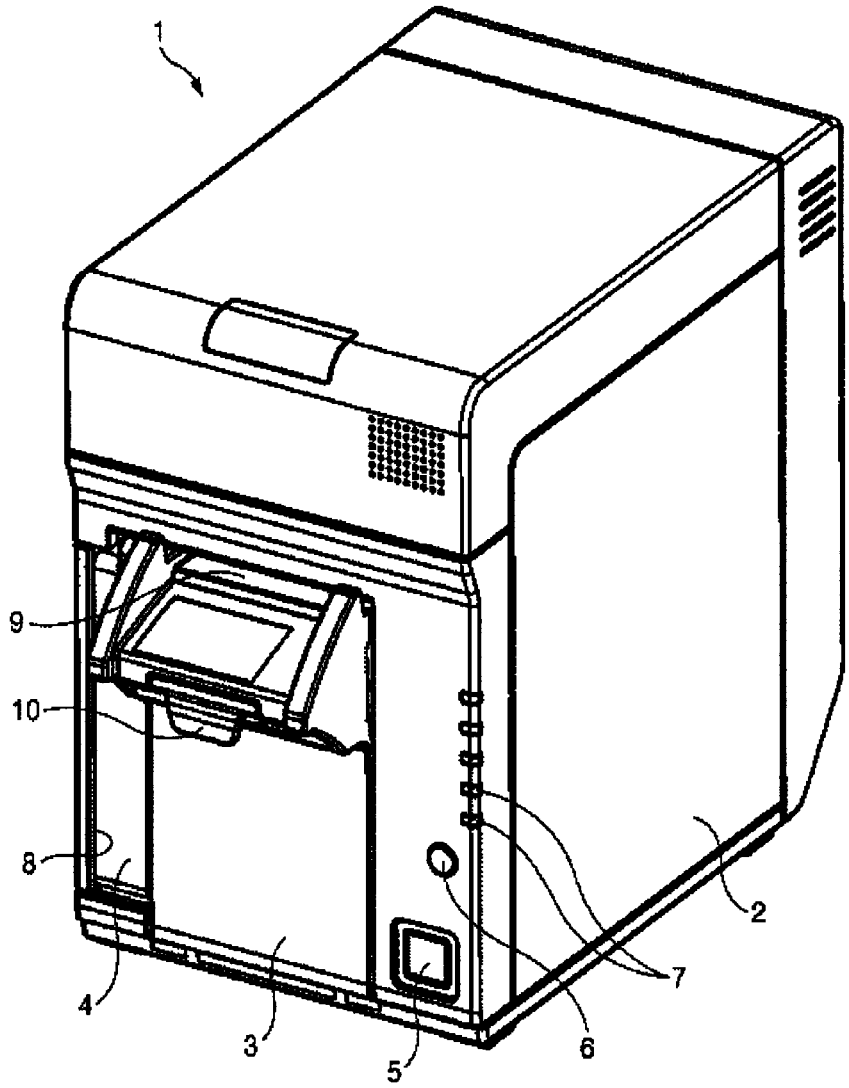
FIG. 1 is an external oblique view of a printer 1 (inkjet printer) according to the related art.

Preferred embodiments of a printer 40 according to the present invention are described below with reference to the accompanying figures. Note that like parts are referenced by like reference numerals in the figures, and redundant description is simplified or omitted.

For convenience, a printer 1 according to the related art is described first, and an example of a printer 40 according to the invention is then described, focusing on differences with the printer 1 of the related art.

As shown in FIG. 1, an inkjet printer 1 (printer) according to the related art prints in color on part of supplied roll paper using multiple color inks, and a roll paper cover 3 that opens and closes freely is disposed in the middle front part of the external printer case 2. Beside the roll paper cover 3 is an ink cartridge insertion opening 8, through which an ink cartridge 4 is inserted and stored inside. A power switch 5, feed switch 6, and indicators 7 are also disposed in the front of the printer case 2.

Figure 2:
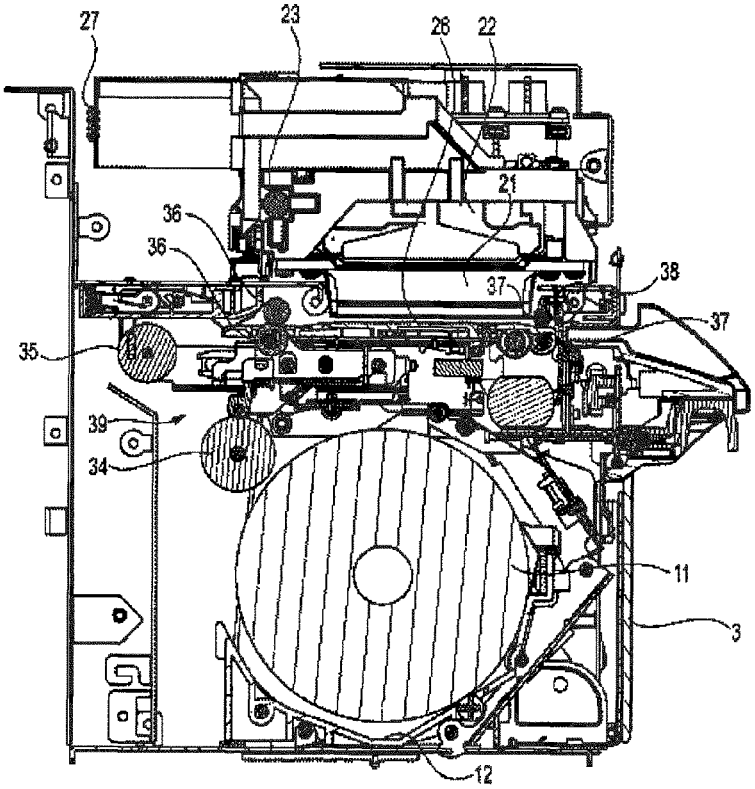
FIG. 2 is a side view of the printer 1 in FIG. 1 with the printer case removed.

As shown in FIG. 2, roll paper 11 (paper), which is the print medium, is stored in a roll paper compartment 12. Opening the roll paper cover 3 opens the roll paper compartment 12 storing the roll paper 11, enabling replacing the roll paper 11.

The roll paper cover 3 can pivot on the bottom end thereof and open to the front. Above the roll paper cover 3 is disposed a paper exit 9 from which the printed roll paper is discharged to the front, and an openable slider 10 that can slide to the front is disposed at the distal end of the paper exit 9.

When the openable slider 10 is pulled forward, the openable slider 10 moves forward and unlocks. As the openable slider 10 is pulled further forward, the roll paper cover 3 pivots on the bottom end and opens, the roll paper compartment 12 located behind the roll paper cover 3 is exposed, and a paper roll can be dropped into the roll paper compartment 12.

Figure 3:
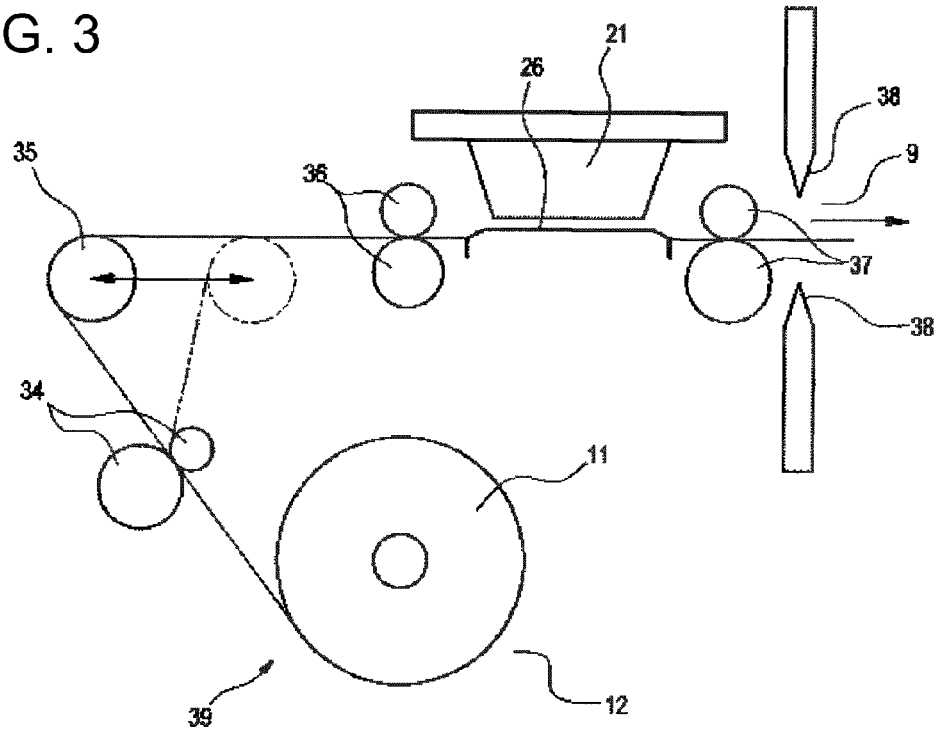
FIG. 3 is a schematic side view of the conveyance mechanism used to describe the configuration of the conveyance mechanism of the printer 1 in FIG. 1.

As shown in FIG. 3, at the top rear part of the roll paper compartment 12 are delivery rollers 34 that deliver the roll paper 11 stored in the roll paper compartment 12 as a continuous sheet. A roll paper supply device 39 that delivers and supplies the roll paper 11 in sheet form is embodied by the roll paper compartment 12 and delivery rollers 34.

Downstream from the delivery rollers 34 is a main conveyance roller pair 36 (referred to below as as conveyance rollers 36) that holds and conveys the roll paper 11. A tension roller 35 that is urged toward the back of the printer by an urging member (not shown in the figure) to maintain constant tension on the roll paper 11 delivered to the conveyance rollers 36 is disposed to the conveyance path between the delivery rollers 34 and conveyance rollers 36.

Downstream from the conveyance rollers 36 is a front conveyance roller pair 37 (referred to below as as discharge rollers 37) that holds and conveys the roll paper 11. A platen 26 is disposed between the conveyance rollers 36 and discharge rollers 37. A cutter 38 for cutting the printed roll paper 11 is disposed at the paper exit 9.

The roll paper 11 is pulled from the roll paper compartment 12, passes the tension roller 35, conveyance rollers 36, platen 26, and discharge rollers 37, and is discharged from the paper exit 9.

The delivery rollers 34 produce the paper conveyance force that pulls the roll paper 11 stored in the roll paper compartment 12 in sheet form. Because rotation is controlled with high precision, the the conveyance rollers 36 convey the roll paper 11 at a highly precise paper feed pitch. The tension roller 35 stabilizes the paper feed precision by maintaining a constant load on the conveyance rollers 36, and enables high speed conveyance by maintaining a constant amount of slack in the roll paper 11.

The discharge rollers 37 conveys the roll paper 11 to the paper exit 9 while holding the roll paper 11 sheet therebetween with sufficient force. As a result, uplift of the roll paper 11 at the platen 26 can therefore be prevented, and printing can continue desirably when the printed roll paper 11 discharged to the paper exit 9 is torn off without paper jams being caused by the paper lifting up.

The conveyance speed of the discharge rollers 37 is also set greater than the conveyance rollers 36. As a result, specific tension is applied to the roll paper 11 between the conveyance rollers 36 and discharge rollers 37, and the roll paper 11 is prevented from lifting away from the top of the platen 26 and contacting the inkjet head 21.

Figure 4:
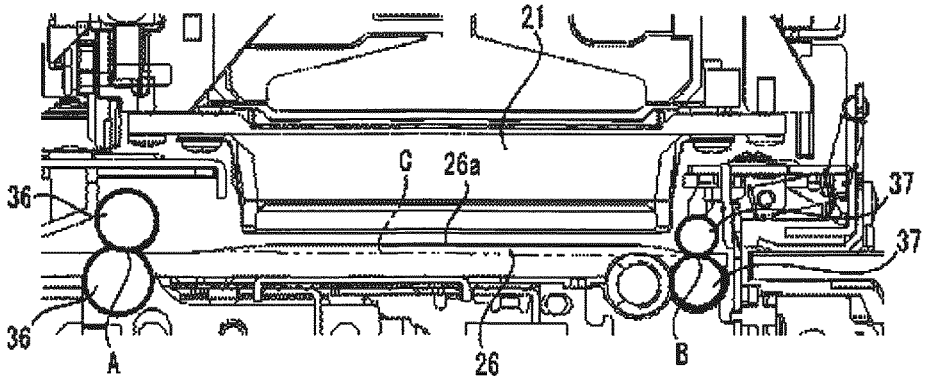
FIG. 4 is a side view of the area around the print processing unit of the printer 1 in FIG. 1.
Figure 5:
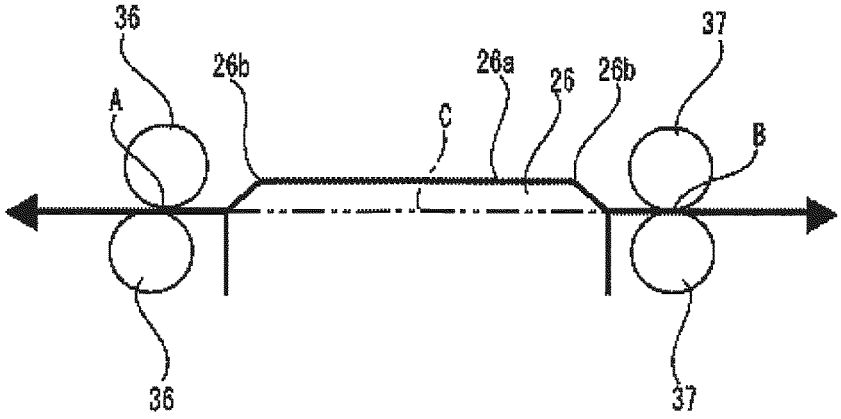
FIG. 5 is a schematic side view illustrating conveyance of roll paper in the area around the print processing unit of the printer 1 in FIG. 1.

As shown in FIG. 4 and FIG. 5, the platen surface 26*a*, which is the top of the platen 26, is located on the inkjet head 21 side of an imaginary plane C through position A where the roll paper 11 is held by the conveyance rollers 36, and position B where the roll paper 11 is held by the discharge rollers 37.

As a result, the roll paper 11 to which tension is constantly applied by the conveyance rollers 36 and discharge rollers 37 is constantly pressed to and held adhered to the platen surface 26*a* of the platen 26, and good flatness is maintained below the inkjet head 21.

In addition, the center axis of the upper conveyance roller 36 is offset in the conveyance direction of the roll paper 11 to a position on the downstream side of the center axis of the lower conveyance roller 36. As a result, the roll paper 11 held by the conveyance rollers 36 is fed at a downward angle to the platen 26. In other words, because the roll paper 11 is conveyed in the direction pushing down against the platen surface 26*a* of the platen 26, adhesion to the platen surface 26*a* is increased.

As shown in FIG. 5, an edge 26*b* is formed across the width of the platen surface 26*a* on the end on the conveyance roller 36 side and the end on the discharge roller 37 side. As a result, the flatness of the roll paper 11 on the platen surface 26*a* is effectively improved between the edges 26*b*.

As shown in FIG. 2, a carriage 22 carrying an inkjet head 21 (printhead) embodying the print processing unit of this inkjet printer 1 is disposed above the roll paper compartment 12 inside the printer case 2. The carriage 22 is supported freely movably on guide members 23 extending across the width of the roll paper 11, and, by means of an endless belt (not shown in the figure) extending widthwise to the roll paper 11 and a carriage motor (not shown in the figure) that drives the endless belt, can travel bidirectionally above the platen 26 across the width of the roll paper 11. A flexible ink tube 27 communicating with the ink cartridge is connected to the carriage 22, and ink is supplied through this ink tube 27 from the ink cartridge 4 to the inkjet head 21 on the carriage 22.

The standby position (home position) of the bidirectionally moving carriage 22 is on one side of the width of the inkjet printer 1. Below the standby position is an ink suction mechanism (not shown in the figure) that suctions ink from the ink nozzles of the inkjet head 21, which are exposed below the carriage 22.

The inkjet printer 1 configured as described above prints by ejecting ink from the inkjet head 21 carried by the bidirectionally moving carriage 22 onto the delivered part of the roll paper 11.

The platen surface 26*a*, which is the top of the platen 26, is located on the inkjet head 21 side of a plane C through position A where the roll paper 11 is held by the conveyance rollers 36, and position B where the roll paper 11 is held by the discharge rollers 37.

As a result, the roll paper 11 is constantly pressed to and held tight against the platen surface 26*a* of the platen 26, and good flatness is maintained in the roll paper 11 below the inkjet head 21. Ink ejected from the inkjet head 21 can therefore be consistently placed on the roll paper 11 held with good flatness on the platen surface 26*a*.

More specifically, the inkjet printer 1 described above significantly suppresses cost increases compared with constructions that hold the roll paper 11 to the platen 26 by means of a complicated suction mechanism or electrostatic conveyance mechanism, prevents the roll paper 11 from lifting up and maintains good flatness in the print processing unit, and can print with extremely high quality.

More particularly, because the conveyance speed of the roll paper 11 by the discharge rollers 37 is set greater than the conveyance speed of the roll paper 11 by the conveyance rollers 36, appropriate tension can be constantly maintained in the roll paper 11 on the platen 26, and adhesion of the roll paper 11 to the platen surface 26*a* can be increased and flatness improved.

A printer 40 according to a preferred embodiment of the invention is described next.

Figure 6:
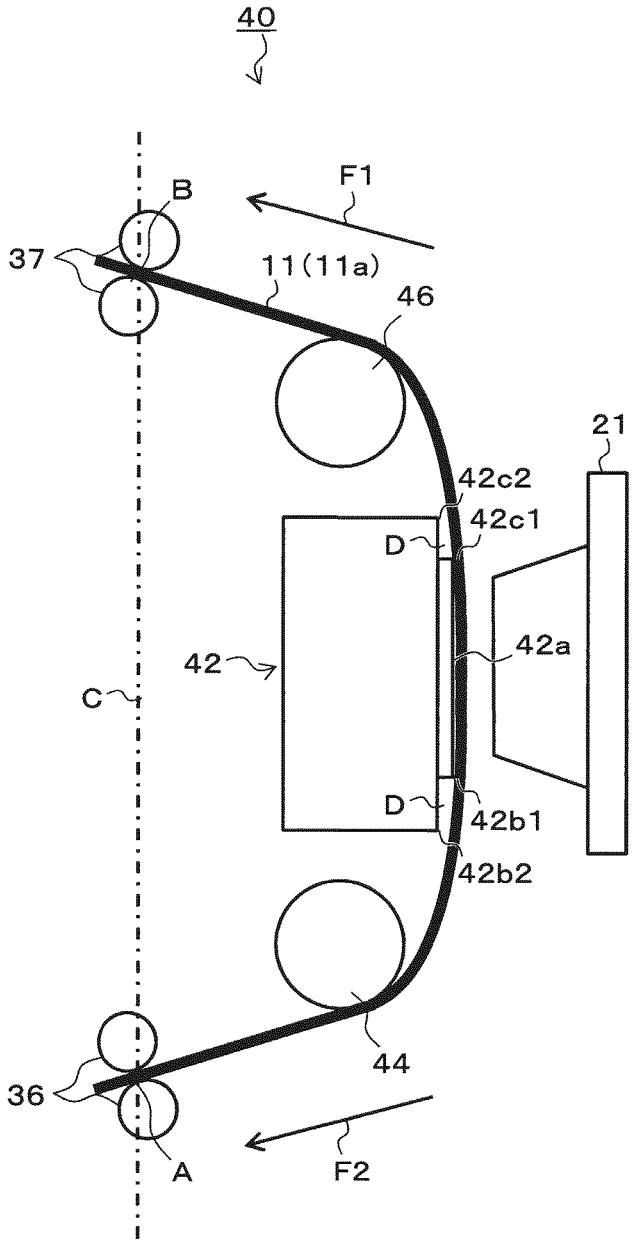
FIG. 6 illustrates the configuration around the platen 42 of a printer 40 according to a preferred embodiment of the invention.

FIG. 6 schematically illustrates the configuration of the area around the platen 42 of the printer 40.

The printer 40 according to this embodiment is equivalent to the printer 1 of the related art shown in FIG. 2 and FIG. 3 rotated 90 degrees left. As shown in FIG. 6, the printer 40 according to this embodiment differs from the printer 1 according to the related art described above by: having a platen 42 of a different shape than the platen 26; adding an entry angle control unit 44 and an exit angle control unit 46; the inkjet head 21 (printhead) being disposed to eject ink horizontally from the plural nozzles; the platen 42 having a platen surface 42*a* opposite the inkjet head 21; and the paper exit 9 from which the roll paper 11 is discharged after printing being on the top of the printer 40 instead of a side of the printer 40 (not shown in the figure) ; and is otherwise the same as the printer 1 of the related art described above.

The printer 40 according to this embodiment is described below focusing on the differences with the above printer 1 according to the related art, and like configurations in this and the printer 1 according to the related art are identified by like reference numerals and further description thereof is simplified or omitted.

Figure 7:
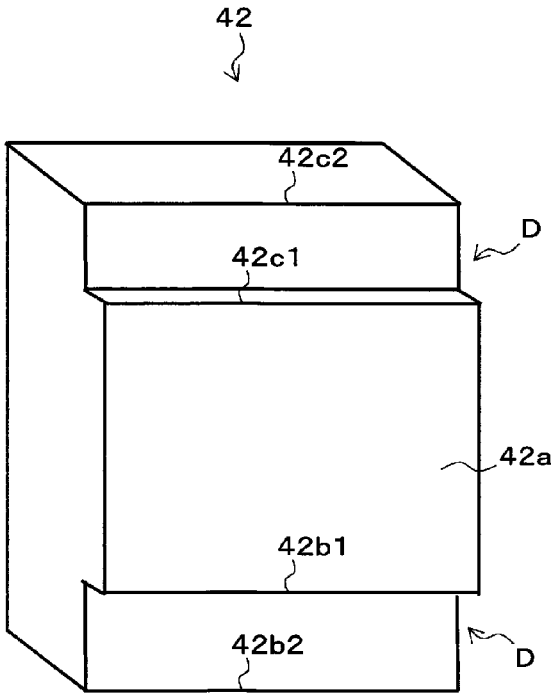
FIG. 7 is an oblique view of an example of the platen 42.

FIG. 7 is an oblique view showing an example of the platen 42.

As shown in FIG. 6 and FIG. 7, the platen 42 has a platen surface 42*a* opposite the inkjet head 21. While not shown in the figures, the platen 42 is supported by a frame of the printer 40, for example.

The platen surface 42*a* is a flat platen with a rectangular shape, and has a first contact part 42*b*1 that contacts the roll paper 11 (roll paper 11*a* of a first basis weight and roll paper 11*b* of a second basis weight described below) on the upstream side in the media conveyance direction, and a second contact part 42*c*1 that contacts the roll paper 11 (roll paper 11*a* of a first basis weight and roll paper 11*b* of a second basis weight described below) on the downstream side in the media conveyance direction. The platen surface 42*a* is disposed on the inkjet head 21 side of plane C through position A where the roll paper 11 is held by the conveyance rollers 36, and position B where the roll paper 11 is held by the discharge rollers 37.

The platen 42 also a third contact part 42*b*2 that is upstream from the first contact part 42*b*1 and on the opposite side of the platen surface 42*a* as the inkjet head 21 (that is, is farther from the inkjet head 21 than the platen surface 42*a*), and contacts roll paper 11 (roll paper 11*b* of a second basis weight described below); and a fourth contact part 42*c*2 that is downstream from the second contact part 42*c*1 and on the opposite side of the platen surface 42*a* as the inkjet head 21 (that is, is farther from the inkjet head 21 than the platen surface 42*a*), and contacts roll paper 11 (the second-basis-weight roll paper 11*b*).

More specifically, the third contact part 42*b*2 is disposed to a position where the entry angle (FIG. 9) of roll paper 11*b* of a second basis weight (a basis weight of 45 kg, for example) to the platen surface 42*a* is shallow, that is, to a position where the entry angle of second-basis-weight roll paper 11*b* to the platen surface 42*a* is shallow so that second-basis-weight roll paper 11*b* substantially contacts the platen surface 42*a*.

The fourth contact part 42*c*2 is disposed to a position where the exit angle (FIG. 9) of roll paper 11*b* of a second basis weight (a basis weight of 45 kg, for example) to the platen surface 42*a* is shallow, that is, to a position where the exit angle of second-basis-weight roll paper 11*b* to the platen surface 42*a* is shallow so that second-basis-weight roll paper 11*b* substantially contacts the platen surface 42*a*.

Note that the number of third and fourth contact parts 42*b*2, 42*c*2 is not specifically limited, and there may be one or more of each. More specifically, there is at least one third contact part 42*b*2 and one fourth contact part 42*c*2.

The contact parts 42*b*1, 42*b*2, 42*c*1, 42*c*2 in this example are configured as edges across the width (the direction perpendicular to the paper surface in FIG. 6) of the roll paper 11 (paper).

There is also a step D between the first contact part 42*b*1 and third contact part 42*b*2, and between the second contact part 42*c*1 and fourth contact part 42*c*2 (see FIG. 6, FIG. 7). The invention is obviously not so limited, however, and there may be a slope E between the first contact part 42*b*1 and third contact part 42*b*2, and between the second contact part 42*c*1 and fourth contact part 42*c*2 (see FIG. 8).

The entry angle control unit 44 in this example is a roller (such as a follower roller) that contacts the roll paper 11 (particularly first-basis-weight roll paper 11*a*) conveyed by the conveyance rollers 36 toward the platen surface 42*a* to control the entry angle of the roll paper 11 to the platen surface 42*a*, and while not shown in the figures, its axis of rotation is extends widthwise (the direction perpendicular to the paper surface in FIG. 6) to the roll paper 11 (paper), and the entry angle control unit 44 is supported by a frame member of the printer 40, for example.

As shown in FIG. 6, the entry angle control unit 44 is on the inkjet head 21 side of plane C, between the platen 42 (first contact part 42*b*1) and conveyance rollers 36.

More specifically, the entry angle control unit 44 is disposed on the inkjet head 21 side of plane C, at a position between the platen 42 (first contact part 42*b*1) and conveyance rollers 36 where the entry angle of roll paper 11*a* of a first basis weight (a basis weight of 55 kg, for example) to the platen surface 42*a* is shallow, that is, to a position where the entry angle of first-basis-weight roll paper 11*a* to the platen surface 42*a* is shallow so that first-basis-weight roll paper 11*a* substantially contacts the platen surface 42*a*.

Note that the basis weight is the weight (kg) per 1000 sheets, paper with a high basis weight (first-basis-weight roll paper 11*a* in this example) is thick (strong, stiff), and paper with a low basis weight (second-basis-weight roll paper 11*b* in this example) is thin (weak, bendable).

Note that the number of entry angle control units 44 is not specifically limited, and there maybe one or more. More specifically, there is at least one entry angle control unit 44.

The exit angle control unit 46 in this example is a roller (such as a follower roller) that contacts the roll paper 11 (particularly first-basis-weight roll paper 11*a*) conveyed by the discharge rollers 37 in the direction away from the platen surface 42*a* to control the exit angle of the roll paper 11 to the platen surface 42*a*, and while not shown in the figures, its axis of rotation is extends widthwise (the direction perpendicular to the paper surface in FIG. 6) to the roll paper 11 (paper), and the exit angle control unit 46 is supported by a frame member of the printer 40, for example.

As shown in FIG. 6, the exit angle control unit 46 is on the inkjet head 21 side of plane C, between the platen 42 (second contact part 42*c*1) and discharge rollers 37.

More specifically, the exit angle control unit 46 is disposed on the inkj,et head 21 side of plane C, at a position between the platen 42 (second contact part 42*c*1) and discharge rollers 37 where the exit angle of roll paper 11*a* of a first basis weight (a basis weight of 55 kg, for example) to the platen surface 42*a* is shallow, that is, to a position where the exit angle of first-basis-weight roll paper 11*a* to the platen surface 42*a* is shallow so that first-basis-weight roll paper 11*a* substantially contacts the platen surface 42*a*.

Note that the number of exit angle control units 46 is not specifically limited, and there maybe one or more. More specifically, there is at least one exit angle control unit 46.

As shown in FIG. 6, when conveying roll paper 11*a* of a first basis weight (such as 55 kg), the entry angle control unit 44 contacts the first-basis-weight roll paper 11*a* conveyed toward the platen surface 42*a* by the conveyance rollers 36, and controls the entry angle of the first-basis-weight roll paper 11*a* to the platen surface 42*a* to a shallow angle; and the exit angle control unit 46 contacts the first-basis-weight roll paper 11*a* conveyed away from the platen surface 42*a* by the discharge rollers 37, and controls the exit angle of the first-basis-weight roll paper 11*a* to the platen surface 42*a* to a shallow angle.

As a result, as shown in FIG. 6, when conveying roll paper 11*a* of of a first basis weight (such as 55 kg), the first-basis-weight roll paper 11*a* contacts the entry angle control unit 44, exit angle control unit 46, first contact part 42*b*1, and second contact part 42*c*1, does not contact the third contact part 42*b*2 and fourth contact part 42*c*2, and remains substantially tight against the platen surface 42*a*.

Figure 9:
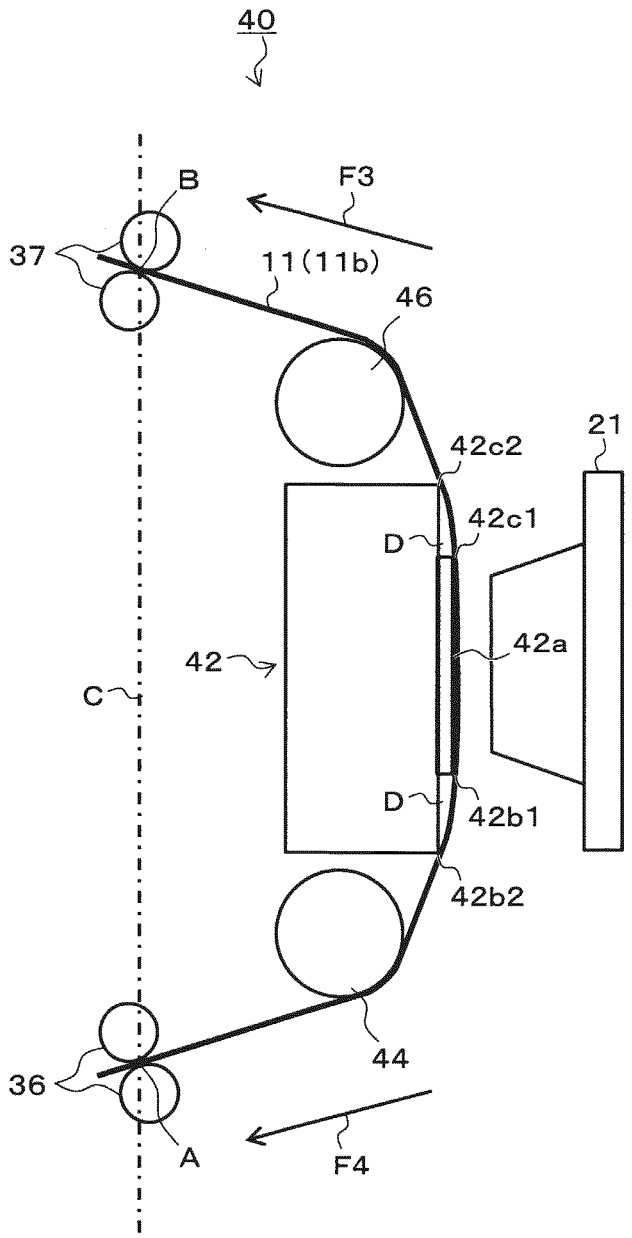
FIG. 9 illustrates the configuration around the platen 42 of the printer 40.

However, as shown in FIG. 9, when conveying roll paper 11*b* of a second basis weight (such as 45 kg), the third contact part 42*b*2 (and entry angle control unit 44 and other parts) contacts the second-basis-weight roll paper 11*b* conveyed by the conveyance rollers 36 toward the platen surface 42*a*, and controls the entry angle of the roll paper 11*b* to the platen surface 42*a* to a shallow angle; and the fourth contact part 42*c*2 (and exit angle control unit 46 and other parts) contacts the roll paper 11*b* of a second basis weight (such as 45 kg) conveyed away from the platen surface 42*a* by the discharge rollers 37, and controls the exit angle of the first-basis-weight roll paper 11*a* to the platen surface 42*a* to a shallow angle.

As a result, as shown in FIG. 9, when conveying roll paper 11*b* of a second basis weight (such as 45 kg), the second-basis-weight roll paper 11*b* contacts the entry angle control unit 44, exit angle control unit 46, first contact part 42*b*1, second contact part 42*c*1, third contact part 42*b*2, and fourth contact part 42*c*2, and remains substantially adhered to the platen surface 42*a*.

As described above, this embodiment of the invention provides a printer 40 that can suppress uplift of paper from the platen and is not easily affected by the type of paper, and more specifically provides a printer 40 that, even when conveying roll paper 11*a* of a first basis weight (strong, stiff paper) (that is, regardless of the strength of the paper), can prevent the first-basis-weight roll paper 11*a* (paper) from lifting up from the platen surface 42*a*.

This is because the operation of entry angle control unit 44 maintains a shallow entry angle of the first-basis-weight roll paper 11*a* to the platen surface 42*a*, and the exit angle control unit 46 maintains a shallow exit angle between the first-basis-weight roll paper 11*a* and the platen surface 42*a*.

Furthermore, because the platen surface 42*a* is on the inkjet head 21 side of plane C, and the discharge rollers 37 turn faster than the conveyance rollers 36, the first-basis-weight roll paper 11*a* is pulled in the direction of arrows F1 and F2 in FIGS. 6, and as a result, the first-basis-weight roll paper 11*a* is pulled to the platen surface 42*a* and held substantially adhered to the platen surface 42*a* (see FIG. 6). The first and second contact parts 42*b*1, 42*c*1 thus contact (line contact) the first-basis-weight roll paper 11*a* while separation of the first-basis-weight roll paper 11*a* from the platen surface 42*a* is suppressed. However, the third and fourth contact part 42*b*2, 42*c*2 do not contact (line contact) the first-basis-weight roll paper 11*a*.

This embodiment of the invention also suppresses separation of the second-basis-weight roll paper 11*b* from the platen surface 42*a* when conveying roll paper 11*b* (weak paper) of a second basis weight (such as a basis weight of 45 kg) instead of roll paper 11*a* of a first basis weight (such as 55 kg).

This is because the operation of the third contact part 42*b*2 (and entry angle control unit 44 and other parts) maintains a shallow entry angle between the second-basis-weight roll paper 11*b* and the platen surface 42*a*, and the fourth contact part 42*c*2 (and exit angle control unit 46 and other parts) maintains a shallow exit angle between the second-basis-weight roll paper 11*b* and the platen surface 42*a*.

Furthermore, because the platen surface 42*a* is on the inkjet head 21 side of plane C, and the discharge rollers 37 turn faster than the conveyance rollers 36, the second-basis-weight roll paper 11*b* is pulled in the direction of arrows F3 and F4 in FIG. 9, and as a result, the second-basis-weight roll paper 11*b* is pulled to the platen surface 42*a* and held substantially adhered to the platen surface 42*a* (see FIG. 9). The contact parts 42*b*1, 42*b*2, 42*c*1, 42*c*2 thus contact (line contact) the second-basis-weight roll paper 11*b* while separation of the second-basis-weight roll paper 11*b* from the platen surface 42*a* is suppressed.

Variations of the foregoing embodiment are described below.

In the embodiment described above, the entry angle control unit 44 and exit angle control unit 46 are rollers, but the invention is not so limited.

Figure 10:
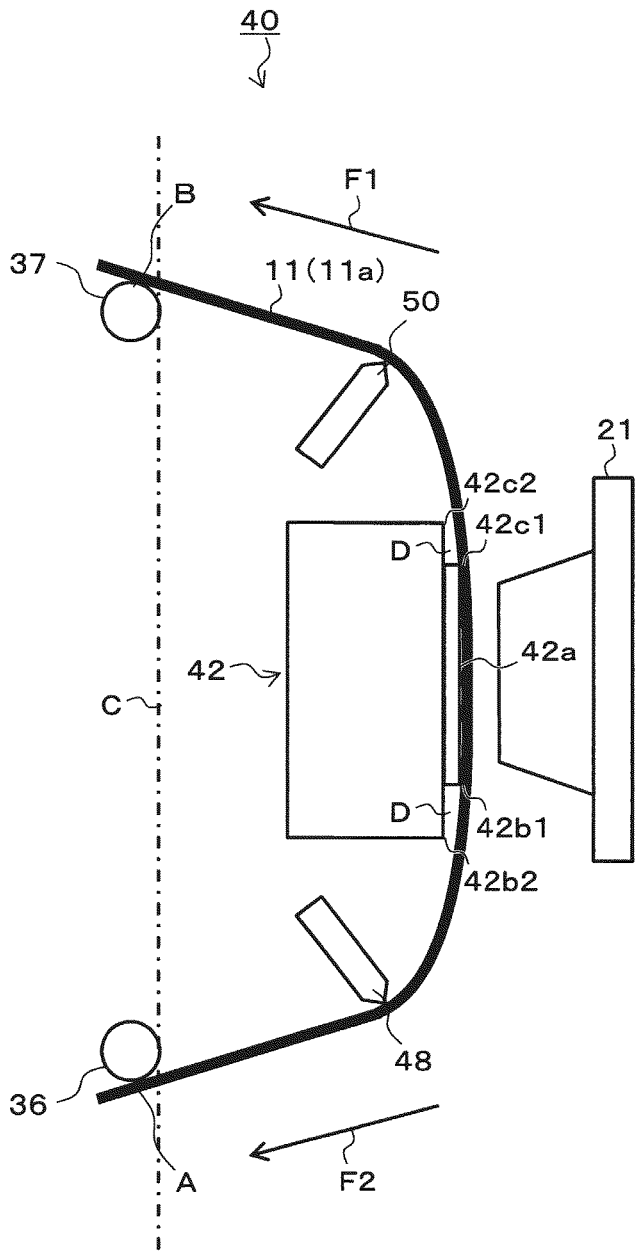
FIG. 10 illustrates a variation of the configuration around the platen 42 of the printer 40.

More specifically, the entry angle control unit 44 may be any configuration that can contact the roll paper 11 (particularly first-basis-weight roll paper 11*a*) conveyed by the conveyance rollers 36 to the platen surface 42*a*, and control the entry angle of the roll paper 11 to the platen surface 42*a*, and may be a line contact part 48 (such as an edge) that line contacts the roll paper 11 as shown in FIG. 10. Likewise, the exit angle control unit 46 may be any configuration that can contact the roll paper 11 (particularly first-basis-weight roll paper 11a) conveyed by the discharge rollers 37 away from the platen surface 42*a*, and control the exit angle of the roll paper 11 to the platen surface 42*a*, and may be a line contact part 50 (such as an edge) that line contacts the roll paper 11 as shown in FIG. 10. Note that the line contact parts 48, 50 extend across the width (the direction perpendicular to the surface of the paper in FIG. 10) of the roll paper 11 (paper).

In the embodiment described above as shown in FIG. 6, the conveyance roller 36 includes a pair of rollers that hold and convey the roll paper 11 toward the platen surface 42*a*, and discharge roller 37 includes a pair of rollers that hold and convey the roll paper 11 away from the platen surface 42*a*, but the invention is not so limited.

For example, as shown in FIG. 10, the conveyance roller 36 may be a single roller. Likewise the discharge rollers 37 may be a single roller. In this configuration, plane C can be defined as a plane tangent to the conveyance roller 36 and discharge roller 37 as shown in FIG. 10.

Furthermore, the foregoing embodiment describes a configuration having third and fourth contact parts 42*b*2, 42*c*2 that contact (line contact) the the second-basis-weight roll paper 11*b*, but the invention is not so limited. For example, the third and fourth contact parts 42*b*2, 42*c*2 may be omitted as appropriate.

Figure 8:
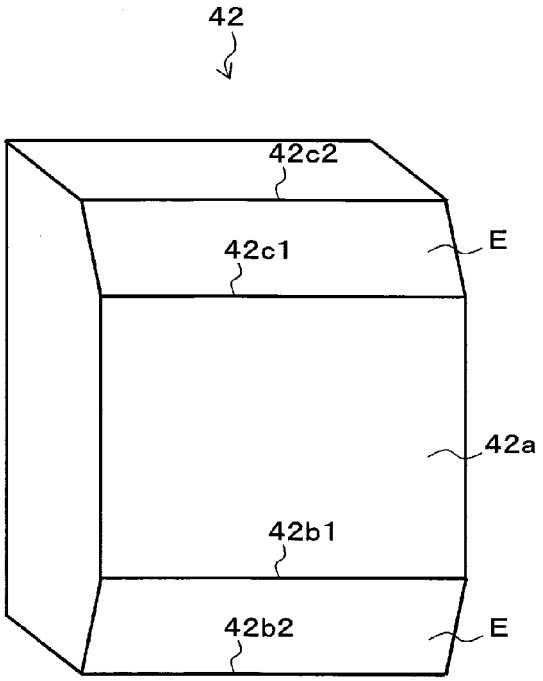
FIG. 8 is an oblique view of another example of the platen 42.

Furthermore, as shown in FIG. 7 and FIG. 8, the foregoing embodiment describes a configuration in which the first contact part 42*b*1 disposed on the upstream side of the platen surface 42*a* in the media conveyance direction, and the second contact part 42*c*1 disposed on the downstream of the platen surface 42*a* in the media conveyance direction, are edges, and the surface (a plastic surface, for example) between the first contact part 42*b*1 and second contact part 42*c*1 is flat, but the invention is not so limited.

Figure 11:
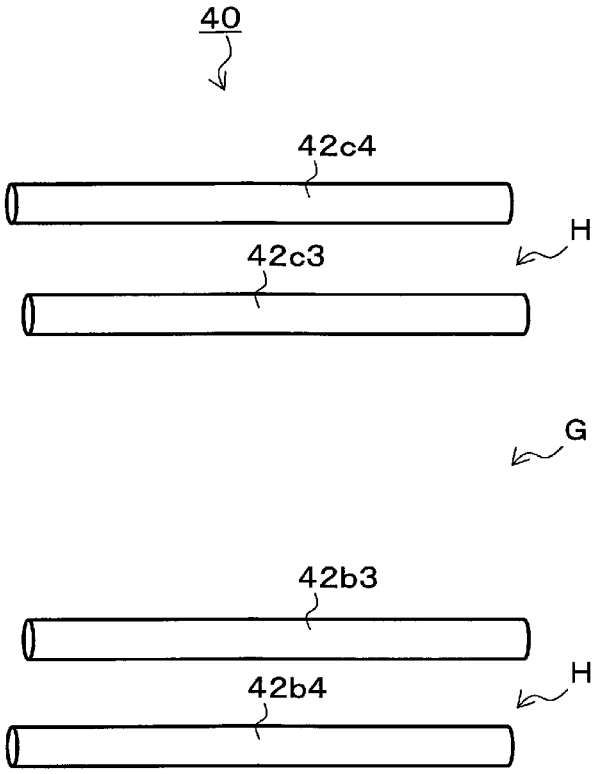
FIG. 11 is an oblique view of another example of the platen 42.
Figure 12:
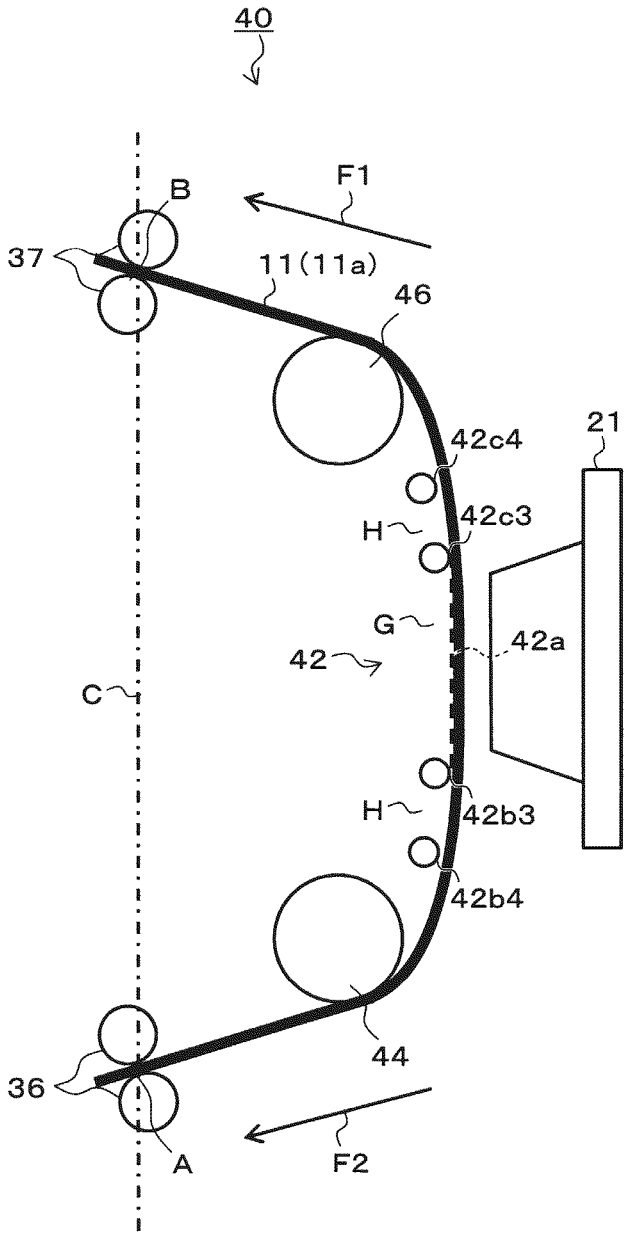
FIG. 12 illustrates a variation of the configuration around the platen 42 of the printer 40.

For example, as shown in FIG. 11 and FIG. 12, the first contact part 42*b*3 and second contact part 42*c*3 may be rollers (such as follower rollers), with the space between the first contact part 42*b*3 and second contact part 42*c*3 an open gap G. In this configuration, the platen surface 42*a* may be defined as the plane tangent to the first contact part 42*b*3 and second contact part 42*c*3 (an imaginary surface between the first contact part 42*b*3 and second contact part 42*c*3). Likewise, as shown in FIG. 11 and FIG. 12, the third contact part 42*b*4 and fourth contact part 42*c*4 may be rollers (such as follower rollers), and the gap between the first contact part 42*b*3 and third contact part 42*b*4, and the gap between the second contact part 42*c*3 and fourth contact part 42*c*4, may be spaces H.

Furthermore, as shown in FIG. 8 and FIG. 9, the contact parts 42*b*1, 42*b*2, 42*c*1, 42*c*2 are described extending in a straight line widthwise to the roll paper 11 (paper) (right-left as seen in FIG. 8 and FIG. 9), but the invention is not so limited.

Figure 13:
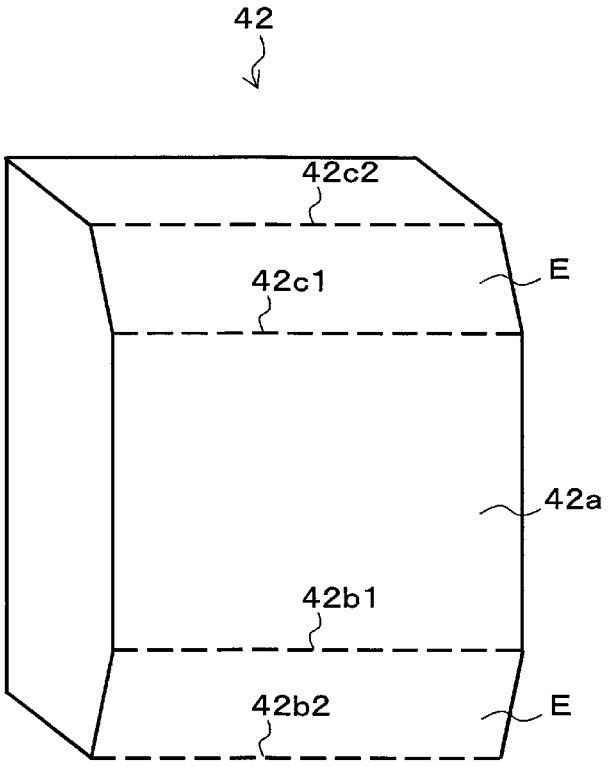
FIG. 13 is an oblique view of a variation of the contact parts 42*b*1, 42*b*2, 42*c*1, 42*c*2.

For example, as shown in FIG. 13, the contact parts 42*b*1, 42*b*2, 42*c*1, 42*c*2 may extend discontinuously (intermittently) widthwise to the roll paper 11 (paper) (right-left as seen in FIG. 8 and FIG. 9).

A printer according to the invention is described above as a printer 40 having the inkjet head 21 disposed with the plural nozzles ejecting ink droplets horizontally (that is, a printer used in a vertical orientation), but the invention is not so limited. For example, the invention can also be applied to the printer 1 according to the related art, that is, a printer 1 having an inkjet head 21 disposed to eject ink droplets vertically down from the plural nozzles (that is, a printer used in a horizontal orientation).

Note also that the foregoing embodiments apply the invention to a printer 40 having an inkjet head 21, but the invention is not so limited and may be applied to printers having a printhead other than an inkjet head.

Note, further, that the quantities described above are for example only, and quantities other than the numbers described above may be used.

The foregoing embodiment is in all aspects only an example. The invention should not be understood as being limited by the foregoing description. The invention can be embodied in many other ways without departing from the spirit or main features described above.

What is claimed is:

1. A printer comprising:

a printhead;

a platen with a platen surface opposite the printhead;

a conveyance roller disposed upstream in the media conveyance direction from the platen to convey paper to the platen surface; and a discharge roller disposed downstream in the media conveyance direction from the platen to convey paper away from the platen surface, the platen surface disposed on the printhead side of a plane tangent to the conveyance roller and discharge roller;

at least one entry angle control unit disposed on the printhead side of the plane between the platen and the conveyance roller, contacting the paper conveyed toward the platen surface, and controlling the entry angle of the paper to the platen surface; and at least one exit angle control unit disposed on the printhead side of the plane between the platen and the discharge roller, contacting the paper conveyed away from the platen surface, and controlling the exit angle of the paper to the platen surface.

2. The printer described in claim 1, wherein:

the conveyance roller is a pair of rollers that hold and convey the paper toward the platen surface;

the discharge roller is a pair of rollers that hold and convey the paper away from the platen surface; and the plane is a plane including the position where the paper is held by the conveyance roller, and the position where the paper is held by the discharge roller.

3. The printer described in claim 1, wherein:

the entry angle control unit is disposed on the printhead side of the plane at a position between the platen and conveyance roller, where the paper substantially contacts the platen surface; and the exit angle control unit is disposed on the printhead side of the plane at a position between the platen and discharge roller, where the paper substantially contacts the platen surface.

4. The printer described in claim 1, wherein:

the platen surface includes at least a first contact part that contacts the paper on the upstream side in the media conveyance direction, and a second contact part that contacts the paper on the downstream side in the media conveyance direction.

5. The printer described in claim 4, wherein:

there is a space between the first contact part and second contact part.

6. The printer described in claim 4, wherein:

the entry angle control unit, exit angle control unit, first contact part, and second contact part are line contact parts or rollers that line contact the paper.

7. The printer described in claim 1, further comprising:

at least one third contact part disposed upstream in the media conveyance direction from the first contact part on the opposite side of the platen surface as the printhead; and at least one fourth contact part disposed downstream in the media conveyance direction from the second contact part on the opposite side of the platen surface as the printhead;

wherein when the paper is paper of a first basis weight, the paper of the first basis weight contacts the platen surface by contacting the exit angle control unit, first contact part, and second contact part, and not contacting the third contact part and fourth contact part; and when the paper is paper of a second basis weight that is less than the first basis weight, the paper of the second basis weight contacts the platen surface by contacting the entry angle control unit, exit angle control unit, first contact part, second contact part, third contact part, and fourth contact part.

* * * * *